US007017495B2

(12) United States Patent
Sexton

(10) Patent No.: US 7,017,495 B2
(45) Date of Patent: Mar. 28, 2006

(54) GUN FIRING METHOD FOR DISPERSION OF PROJECTILES IN A PATTERN

(76) Inventor: Richard Sexton, 3331 SW. 104th Ct., Miami, FL (US) 33165

( * ) Notice: Subject to any disclaimer, the term of this patent is extended or adjusted under 35 U.S.C. 154(b) by 0 days.

(21) Appl. No.: 10/431,786

(22) Filed: May 6, 2003

(65) Prior Publication Data

US 2004/0231550 A1 Nov. 25, 2004

(51) Int. Cl.
*F42B 10/00* (2006.01)
*F42B 10/60* (2006.01)
*F42B 30/02* (2006.01)

(52) U.S. Cl. ..... 102/439; 102/501; 102/438; 102/293; 89/1.1

(58) Field of Classification Search ..... 102/501, 102/438, 439, 460, 457, 489, 513, 293; 244/3.23; 89/1.1
See application file for complete search history.

(56) References Cited

U.S. PATENT DOCUMENTS

| | | | | |
|---|---|---|---|---|
| 414,989 A | | 11/1889 | Ogilvy | |
| 620,875 A | * | 3/1899 | Baker | 102/506 |
| 1,285,599 A | | 11/1918 | Bennett | |
| 2,897,757 A | | 8/1959 | Kulluck | |
| 3,357,357 A | * | 12/1967 | Voss | 102/516 |
| 3,401,637 A | * | 9/1968 | Briscoe | 102/501 |
| 3,500,714 A | | 3/1970 | Cullinane | |
| 3,949,677 A | * | 4/1976 | Voss | 102/501 |
| 4,102,241 A | * | 7/1978 | Magardo et al. | 89/155 |
| 4,517,898 A | * | 5/1985 | Davis et al. | 102/514 |
| 4,561,357 A | | 12/1985 | Maudal et al. | |
| 4,718,348 A | | 1/1988 | Ferrigno | |
| 4,829,904 A | | 5/1989 | Sullivan | |
| 4,996,924 A | | 3/1991 | McClain | |
| 5,116,224 A | | 5/1992 | Kelsey, Jr. | |
| 5,133,261 A | | 7/1992 | Kelsey, Jr. | |
| 5,295,439 A | * | 3/1994 | Carbone | 102/438 |

(Continued)

FOREIGN PATENT DOCUMENTS

DE 2350596 A1 * 10/1979

(Continued)

OTHER PUBLICATIONS

Daniel Lilja, "A Look At Bullet Imbalance and Twist", Dec. 21, 2002, Internet published, pp. 1-3, publication date verifie by "Wayback Machine".*

(Continued)

*Primary Examiner*—Michael J. Carone
*Assistant Examiner*—James S. Bergin
(74) *Attorney, Agent, or Firm*—Robert R Ward, Jr.

(57) ABSTRACT

A method for the dispersion of projectiles from guns capable of firing multiple projectiles in rapid succession whereby some of the projectiles are modified by moving the center of mass of the projectile away from it's central axis and oriented prior to firing. This, in combination with bring fired from a rifled gun barrel, imparts velocity to the projectile upon exiting the gun barrel at right angles to the barrel. This velocity along with the higher muzzle velocity will cause the modified projectile to diverge away from the trajectory of a standard projectile. The magnitude of the divergence will vary with the distance the projectile's center of mass is away from its central axis, and the placement of the modified projectile strikes around the bull's-eye will be determined by the loading orientation of the modified projectile. Firing a multiplicity of standard and modified projectiles in rapid succession will produce an accurate dispersion pattern on a target, increasing the hit probability on that target.

56 Claims, 10 Drawing Sheets

U.S. PATENT DOCUMENTS 6,202,561 B1 3/2001 Head et al.

FOREIGN PATENT DOCUMENTS

| | | | | |
|---|---|---|---|---|
| DE | 34 39 256 | C1 | * | 1/1986 |
| DE | 4411832 | A1 | * | 8/1994 |
| EP | 0 154 762 | A2 | * | 9/1985 |
| WO | WO 96/41113 | | * | 12/1996 |
| WO | WO 02/14781 | A1 | * | 2/2002 |

OTHER PUBLICATIONS

Jack Lewis and David E. Steele, The Gun Digest Book of Assault Weapons, 2000, pp. 172, 182-186, Krause Publications, Iola, WI.

General Dynamics, 20mm Gatling Gun System, Printout from company's products and services webpage at www.generaldynamics.com showing "F-16" of the "Aircraft Systems".

General Dynamics, 20mm Lightweight Gatling Gun, Printout from company's products and services webpage at www.generaldynamics.com showing "XM-301" of the "Ground Systems".

Terry J. Gander and Charles Q. Cutshaw, Jane's Infantry Weapons, 2002-2003, Jun. 2002, Jane's Information Group.

Terry J. Gander, Jane's Ammunition Handbook, 2001-2002, Dec. 2001, Jane's Information Group.

Jack Lewis and David E. Steele, The Gun Digest Book of Assault Weapons, 2000, pp. 172, 182-186, Krause Publications, Iola WI.

Norman Hitchman, Operation Requirements for an Infantry Hand Weapon, U.S. Army. Jun. 1952, United States, pp. 92, 19, iii, 3, 32, 34.

Macon Fry, "A Proposed Infantry Salvo Weapon," U.S. Army, Jul. 1957, United States, p. 16.

* cited by examiner

GUN FIRING METHOD FOR DISPERSION OF PROJECTILES IN A PATTERN

BACKGROUND OF INVENTION

This invention relates to a gun firing process that produces varied dispersion of shots on a target.

With the advent of guns and firearms much effort has been devoted to their perfection in the art of firing projectiles to reach and destroy specified targets. With the development of machine guns and automatic firing, multiple projectiles could be fired toward a target, thereby allowing for a degree of imprecision in engaging a target. The speed of firing along with moving the gun barrel could create a random dispersion of projectiles and cone of fire, which could cover a broad area around desired target and therefore assure greater chance of striking the target.

The principal of probability is used to decrease the element of chance in striking a target. In various militaries, weapons with greater hit probability are given preference. The goal of achieving greater hit probability is the goal of all guns, pistols, shotguns, assault weapons, machine guns, gattling guns, automatic grenade launchers, and cannons.

Differing targets and threats required different measures and techniques to meet such targets or threats. For example, on a Bradley Fighting Vehicle equipped with a 25MM gun, two potential methods are battlesight technique and precision gunnery. Battlesight gunnery is the quicker technique, but is less accurate than engaging targets with precision gunnery. However, precision gunnery is more accurate but takes more time. In battlefield conditions decisions must be quickly made to determine whether a target is within range and whether there is sufficient time to use precision gunnery. If there is not enough time, battlesight technique is used to fire bursts that create a random dispersion of projectiles that will increase the probability of destroying a target.

Most jets and some heliocopters and gunships are equipped with 20MM gattleing guns that shoot up to 6,000 rounds/min. The guns are used for air-to-air and air-to-surface missions. The barrels of the gattling guns are usually not parallel so that the guns produce a controlled dispersion of projectiles on a target, or an optimum dispersion pattern.

A patent granted to Kullock, U.S. Pat. No. 2,897,757 discloses a gun cartridge having a plurality of bullets which upon firing strike the center of a target as well as above and below, and left and right of a target. It does this by aligning projectiles end to end in a barrel of a gun so that upon firing force is exerted between projectiles. A multitude of small parts is added to the projectiles for this purpose. However, the complexity and multitude of small parts makes it difficult to manufacture. The cartridge is not a standard size and it would not fit into existing guns.

The current methods for producing dispersion are random movement of the gun barrel or unparallel gun barrels on a gattling gun. A target will have varying optimum dispersion patterns depending on size, distance, and speed. What is needed then, is a method of dispersion that is accurate, can be varied for individual targets, and is easy to produce. A true optimum dispersion pattern could then achieve a greater hit probability.

SUMMARY OF THE INVENTION

The present invention advances the art of firing projectiles. The invention is a method for accurate dispersion of projectiles from a fixed gun barrel. The invention consists of firing specialized projectiles that deviate from the path of a conventional projectile and strike the target away from the bullseye. The specialized projectiles accomplish this by taking a mass out of the circumference of the projectile. The center of mass of the projectile is no longer on the central axis of the gun barrel and the centrifugal force from the projectile spinning in the gun barrel, because of the rifling, imparts a force on the projectile at right angles to the barrel. Upon exiting the gun barrel, this velocity along with the much higher muzzle velocity determine how far away from the bullseye the projectile will strike.

More mass taken from the circumference of the projectile will result in the projectile striking the target further away from the bullseye. The dispersion pattern of the strikes around the bullseye is determined by the orientation of the specialized rounds in the chamber of the gun when fired.

The specialized projectiles that are designed not to hit the bullseye can have mass removed from the side of the projectile or the aft end in such a way that the center of mass of the projectile is no longer on the central axis of the projectile. The center of mass of the projectile can also be moved from the central axis by adding mass to the projectile on the circumference.

The specialized projectiles that are designed not to hit the bullseye can be called Off Bullseye Projectiles or OBP. The term OBP can be applied to any bullet, cannon, or projectile, artillery shell, spin-stabilized grenade or any other projectile that has a center mass away from it's central axis and is fired from a rifled gun barrel, the dispersion method of firing multiple OPB mixed with standard projectiles can be called Autodispersion.

Machine guns that are fed by belt or linked cartridges and many submachine guns which are fed by a magazine are ideally suited to Autodispersion. An accurate cone of fire can be produced by feeding standard ammunition plus OBP cartridges to the gun. A means for indicating the orientation of the OBP such as a mark on the cartridge of the OBP would indicate where the center of mass is closest to the circumference of the projectile. One sequence for the ammunition in the belt or magazine would be: a standard cartridge, an OBP cartridge, in the 12 O'clock position, an OBP cartridge in the 6 O'clock position, an OBP cartridge in the 3 O'clock position, an OBP cartridge in the 9 O'clock position, and repeating this sequence for the belt or the magazine. When the machine gun is fired, an accurate dispersion with OBP strikes arranged in a circle 90 degrees apart around the standard projectile strike, is produced every 5 rounds fired by the gun. A dispersion pattern twice the diameter of the previous dispersion at the same distance from the target can be produced by feeding a machine gun a belt that has several OBP2 included in the above loading sequence. The OBP2 would have twice the mass removed as the OBP1.

With the Autodispersion method all of the projectiles fired, standard, OBP1, OBP2, and OBP3 would have to be the same weight, especially at longer ranges so that the muzzle velocity would be the same. This would produce accurate patterns on distant targets.

The M-4 assault weapon and some other M-16 weapons can fire 3 round bursts along with other firing modes. The 3 round burst in combination with Autodispersion will allow the first standard round to go where aimed and two OBP rounds to strike on either side of the standard round, in a three shot horizontal pattern. This shot patter will produce a greater hit probability on a silhouette target. A magazine for assault weapons using Autodispersion should be a straight magazine. The ammunition in the magazine should be one round on top of another instead of being staggered. The magazine that has one round on top of another will be much easier to load for Autodispersion.

The Applicant incorrectly implied that the Heckler Kotch G36E uses a magazine when actually its magazine is staggered.

Standard automatic grenade launchers and grenade launchers with airburst grenades would be suited to Autodispersion. The grenades cover an area with their blast, and an accurate dispersion of the grenades would allow the target area to be covered evenly.

Machine guns that had a custom feeding mechanism would allow the dispersion pattern to be selected, and standard projectiles, OBP1, OBP2, and OBP3 could be combined to form the optimal dispersion pattern for the individual target.

Many gattling guns have a fixed dispersion pattern, and have a linkless ammunition feed system. With autodispersion several different diameters of the dispersion pattern could be chosen depending on the ammunition fed to the gun. With the linkless feed the orientation of the OBP projectile strikes around the bullseye would be random, rather than "aimed" as in the belt fed guns.

In another embodiment of the invention, the individual projectile is divided into several segments. The segments are arranged in the cartridge one ahead of the other, with the individual segments having a center of mass away from the central axis. Upon firing, if the individual segments more massive sides are arranged 180 degrees apart in the gun barrel, the dispersion pattern on the target would be one strike on one side of the bullseye and the second strike on the opposite side. A horizontal two shot dispersion pattern would be suited to the handgun ammunition and would increase the hit probability. Adding a third that had a the center of mass on the central axis, would create a three shot horizontal dispersion pattern with the central shot going to the bullseye.

The cartridge used in the Autodispersion are relatively easy to produce since only slight modifications to the original projectile is all that is necessary. The disintegrating link ammunition belts could be assembled at the factory with various combinations and orientations of standard and OBP ammunition for various dispersion patterns.

The firing order of the OBP rounds would have to be taken into account. Firing one OBP round should be followed by firing another similar OBP round at the opposite side of the bullseye. This would stabilize the gun barrel and from any movement due to the OBP firing.

Many guns currently in use can use Autodispersion to produce an accurate dispersion pattern, and increase the hit probability on a target. Other guns would have to be modified to use Autodispersion.

Some machine guns have stabilized gun barrels, laser range finder, and the atmospheric conditions are taken into account. However, some factors such as the windspeed at distant targets are unknown. An accurate dispersion pattern would increase the hit probability. Autodispersion may increase the stand-off range and the effective range of some guns, and decrease the engagement time so that multiple targets could be destroyed in a more efficient manner.

DETAILED DESCRIPTION OF THE INVENTION

Figure 1:
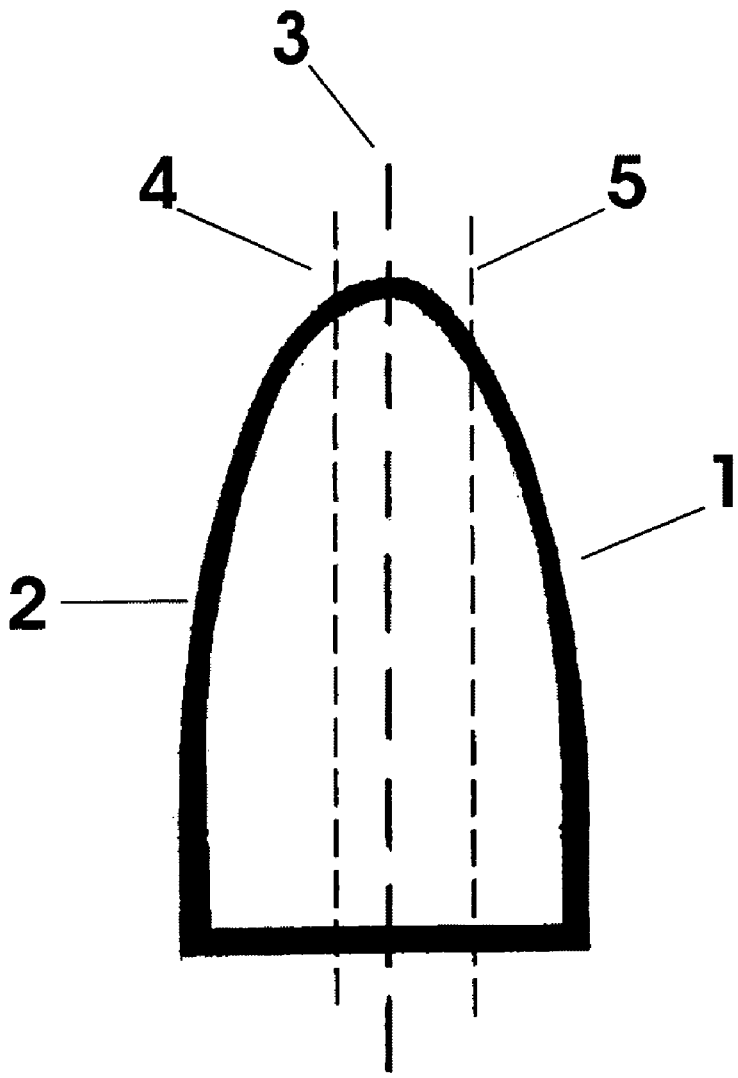
FIG. 1 is a side view of a projectile.

The invention represents a device and method for creating a dispersion of projectiles around a bullseye. FIG. 1 reveals an OBP 1 with a central axis 3 running longitudinally in the center of the body of the OBP 1. The OBP has a side surface 2. An OBP has a center of gravity that is not aligned with, and separate from the central axis 3. The center of gravity can be located a distance from the central axis such as center of gravity 4 and center of gravity 5. The center of gravity can be in any infinite number of locations off the central axis of the OBP 1, as center of gravities 4 and 5 are merely examples.

Figure 2:
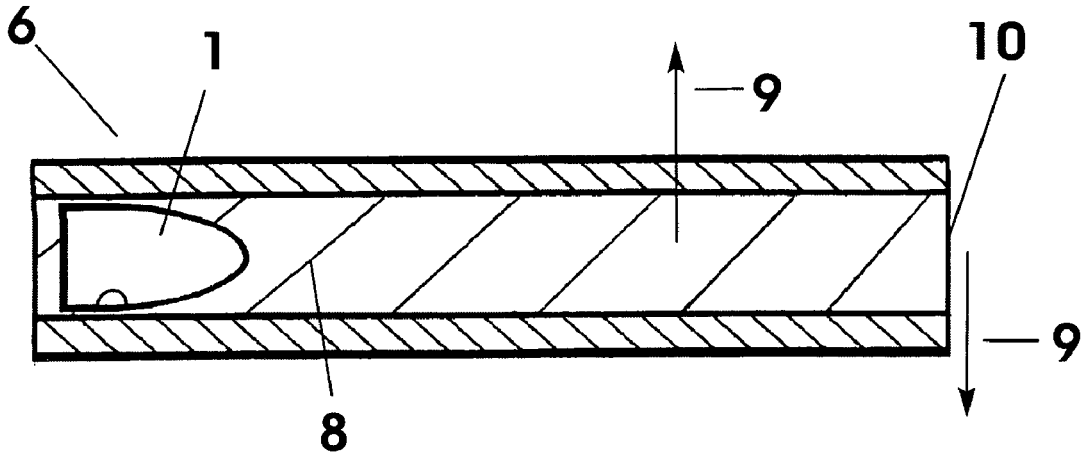
FIG. 2 is a side view of a rifled gun barrel.

A means for imparting spin on the projectile is required, such as a rifled gun. FIG. 2 displays a gun barrel 6 with rifling 8 containing an OBP 1. The rifling 8 imparts a spin to OBP 1 upon firing and passing through the barrel 6. This exerts a centrifugal force 9 on the projectile perpendicular to the longitudinal direction of the barrel. The maximum turns in the rifling will spin the OBP projectile faster and will permit the minimum amount of mass to be removed from the circumference of the projectile for a given distance from the bulls-eye. As the OBP passes through the barrel 6, the direction of the force will be perpendicular to the longitudinal direction of the barrel, however, the force will constantly change in a circular direction because of the spin of the OBP. As the OBP passes through the exit 10, it will diverge in a direction at a right angle to the direction of the force 9. The magnitude of the divergence away from the bullseye is dependant on many factors, such as the magnitude of the centrifugal force, the degree of turns in the rifling to create spin, as well as distance to the target.

The distance the projectile will strike away from the bullseye can be calculated for any OBP. The vectors of the momentum (mass velocity) of the projectile and the momentum of the mass removed or added will determine how far away from the bullseye the projectile will strike. The velocity of the mass added or removed can be calculated by multiplying the revolution/second by the distance traveled in one revolution of the center of mass around the axis of the projectile. The muzzle velocity, weight and location of the center of mass removed or added, and the final weight of the projectile are taken into account to determine the amount of divergence.

Figure 3:
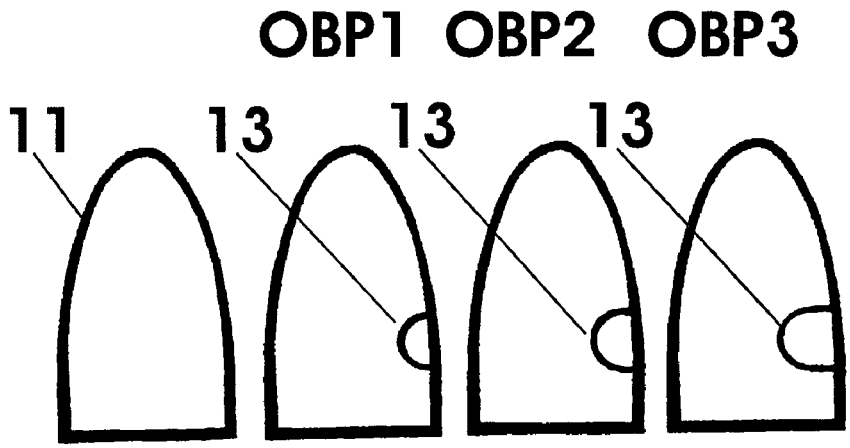
FIG. 3 is a side view of a standard projectile and several OBP projectiles.

The center of gravity of a projectile can be shifted from the central axis in a number of ways. One embodiment is shown in FIG. 3, where a standard projectile 11 with a main body is displayed. Some mass can be removed from the side 12 or circumference of a projectile 11, or a projectile can be formed with mass already removed. Such an absence of mass from a side 12 can leave a recess 13. The absence of mass from a side of a projectile will cause the center of gravity of a projectile to be in a different location than the central axis of the projectile. The center of mass can also be shifted a distance from the central axis of the projectile by adding mass to the side of the main body.

The more mass taken from the circumference of the projectile will result in the projectile striking the target further from a bulls-eye. However, the more mass removed, the more vibration there will be during flight. The vibration is due to the OBP projectile spinning around the center of mass and not the central axis of the projectile. While the magnitude of this vibration is relatively low (0.005 inches for a 30 caliber bullet that strikes the target 10 inches from the bullseye at 100 yds, maximum turns in the rifling would reduce the amount of mass that had to be removed from the projectile. The removal of mass can leave a recess in the side of the projectile. The recess can be located either ahead of, or underneath the cartridge case. The recess may be filled with epoxy or some other material to create a smooth surface to aid aerodynamic flow through the air. The material can have a density that is less than the density of the material which the main body is comprised.

An example of Autodispersion can be seen from a 30 caliber gun. The projectile is normally 7.9 grams. The rifling is one turn in nine inches. Two OBP's are used. OBP1 has 0.4 grams removed from the side of the projectile by drilling a 3/16 inch hole. OBP2 has 0.8 grams removed from the side by drilling two 3/16 inch holes fore and aft in the side of the projectile. At seventy five feet from the target OBP1 strikes the target two and one have inches from the bullseye, and OBP2 strikes the target five inches from the bullseye. Therefore with multiple standard, OBP1 and OBP2 loaded in the proper orientation a forty inch diameter dispersion strike pattern would be created one hundred yards.

In order to keep standard and OBP projectiles of equal mass, an evenly distributed segment of the aft of the projectiles may have to be removed, which will insure that the muzzle velocity is the same for all the projectiles.

Figure 4:
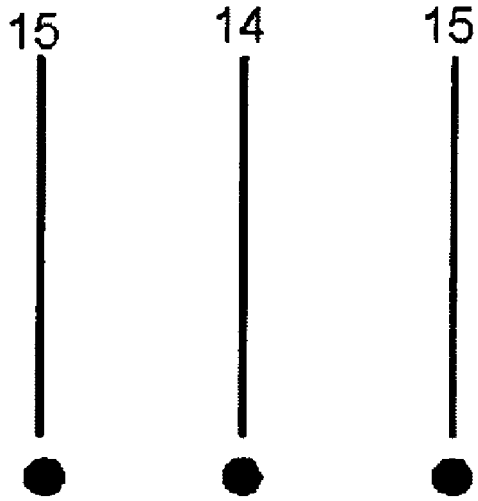
FIG. 4 is a view of one particular dispersal pattern.

The following projectiles are all the same weight. In FIG. 3, mass is removed from the side of a projectile to create OBP1. OBP2 has two times the mass removed compared to OBP1. OBP3 has three times the mass removed compared to OBP1. OBP1, OBP2, and OBP3 can combined with standard projectile 11 to form various dispersion patterns. For example, FIG. 4 shows a horizontal dispersion strike pattern created by a combination of standard projectile and two OBP1 projectiles. The OBP1 target strikes 15 are on either side of the standard projectile target strike 14.

Figure 5:
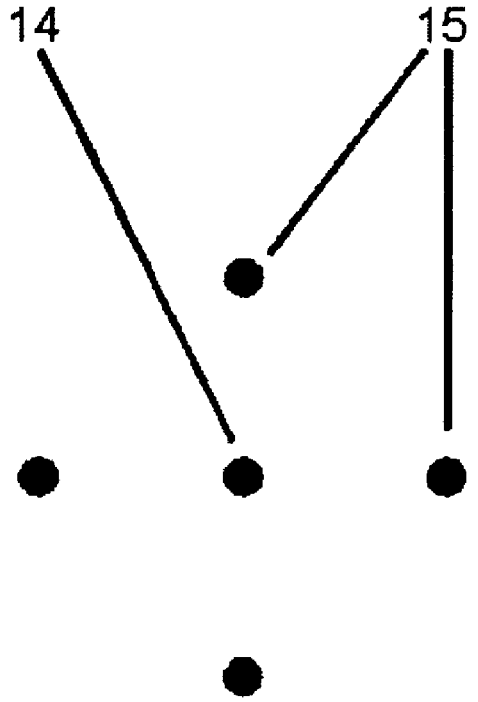
FIG. 5 is a view of one particular dispersal pattern.
Figure 6:
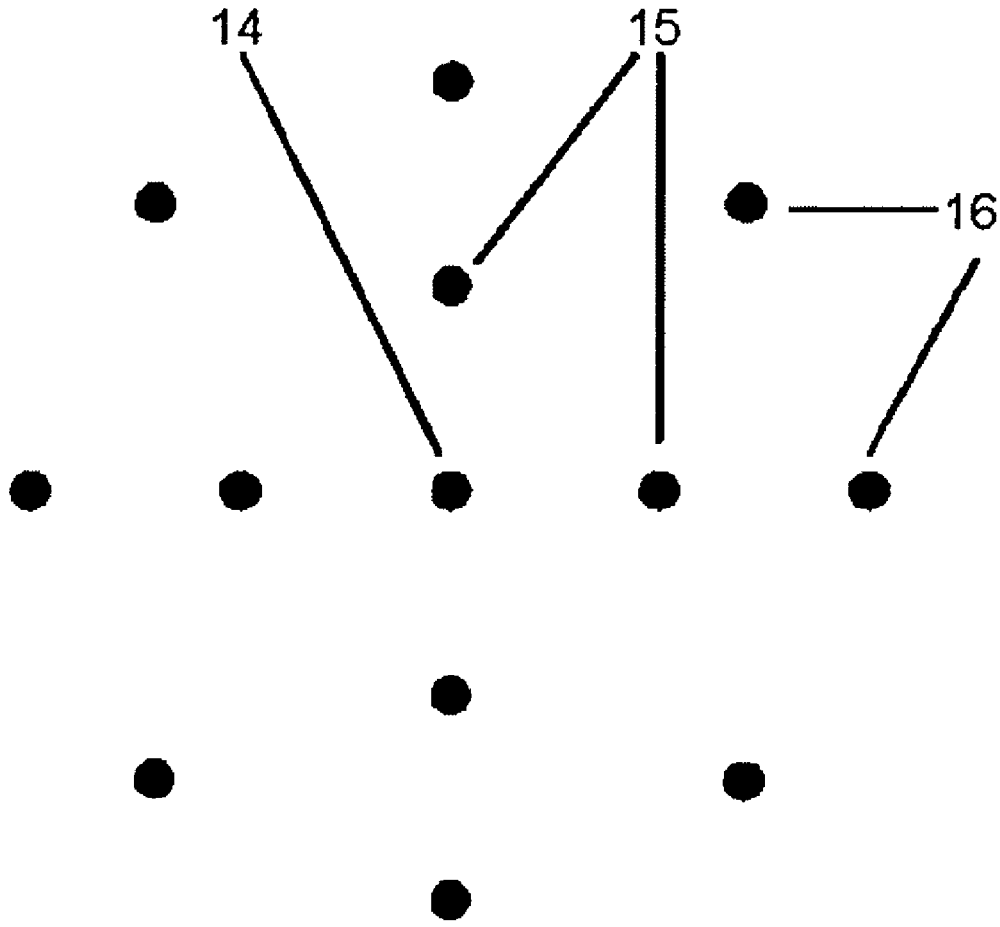
FIG. 6 is a view of one particular dispersal pattern.
Figure 7:
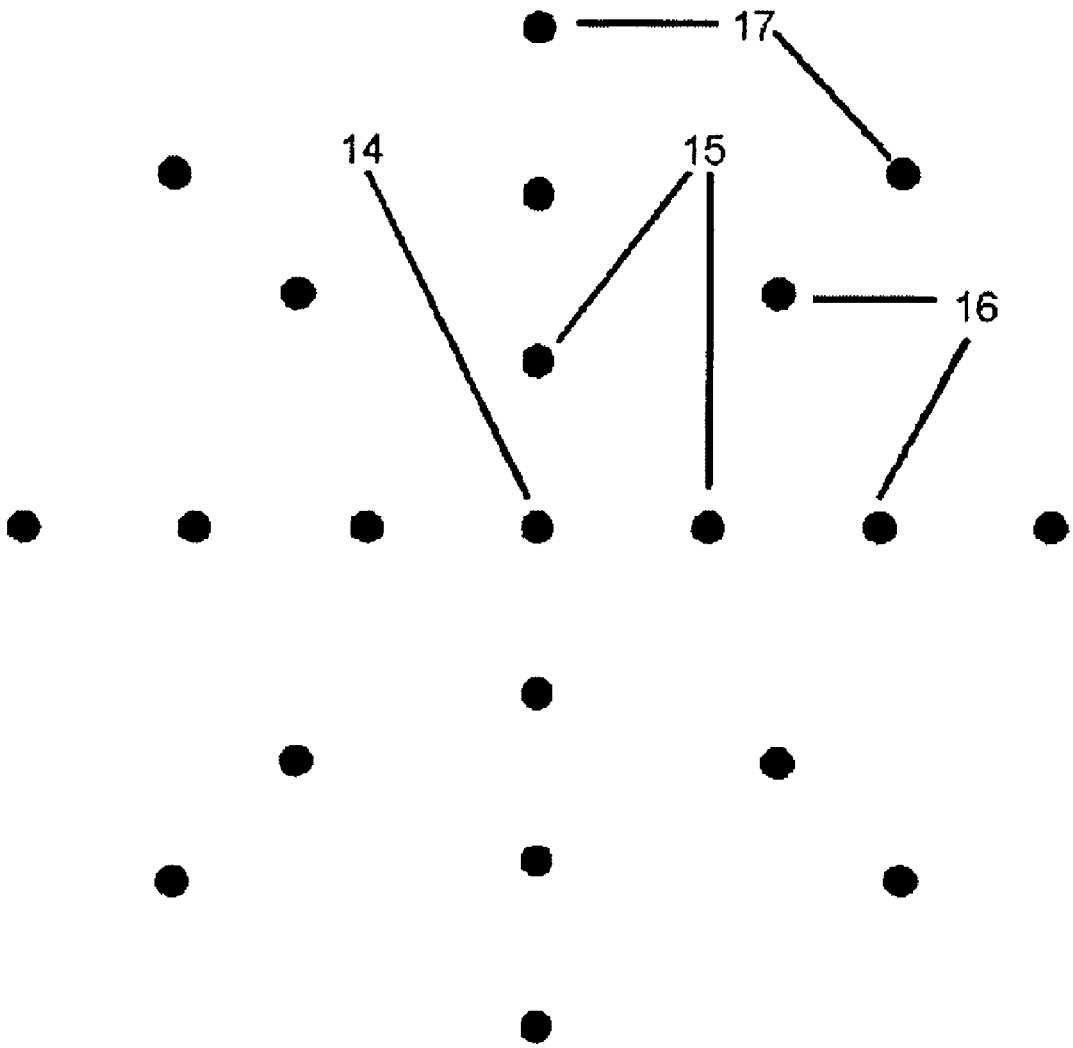
FIG. 7 is view of one particular dispersal pattern.

OBP projectiles can be fired in succession to create strike patterns on a target. FIG. 5 shows a dispersal pattern created by a combination of a standard projectile and four OBP1 projectiles. The OBP projectiles in FIG. 5 would all be fired from a gun with a rifled barrel. OBP1 target strikes 15 are above and below and on either side of the standard projectile target strike 14. FIG. 6 shows a standard projectile in combination with OBP1 and OBP2 projectiles. The OBP2 has more mass removed than OBP1 and therefore one can observe that OBP2 target strikes 16 are further outside the center than OBP1 target strikes 15. FIG. 7 displays another combination with a standard projectile as well as OBP1, OBP2, and OBP3 projectiles. The OBP3 target strikes 17 are further from the center than OBP216 or OBP115 target strikes. Firing different OBP combinations can create one or more strike pattern rings around a bullseye. Combinations are not limited to those mentioned herein, but may be infinite in variety.

Such successive use of OBP projectiles can be applied to many areas of gun use. Assault weapons with a three shot burst capability can benefit from the OBP process by using a standard round with two OBP rounds. This can be used to produce a horizontal three shot pattern as seen in FIG. 4. Therefore with one burst, an area can be hit around a bulls-eye thereby increasing the probability of striking a desired target.

Figure 8:
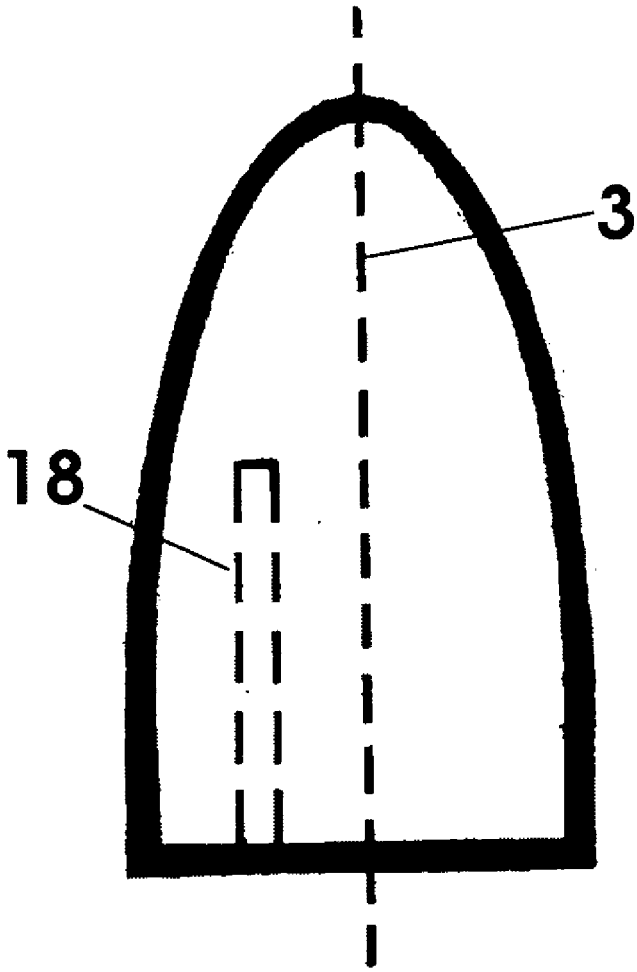
FIG. 8 is a side view of an OBP projectile with a cavity.

Another way of creating OBP is shown in FIG. 8. The center of gravity can be moved by means of a cavity 18 in the body of a projectile between its side surface and its central axis. The cavity can be created by drilling or other technique beneath the surface of the projectile. The cavity is parallel to the center axis 3 of the projectile and lies along the longitudinal length of the projectile. Furthermore, mass of greater density than the density of the main body of the projectile can be added to the cavity to shift the center of mass.

Figure 9:
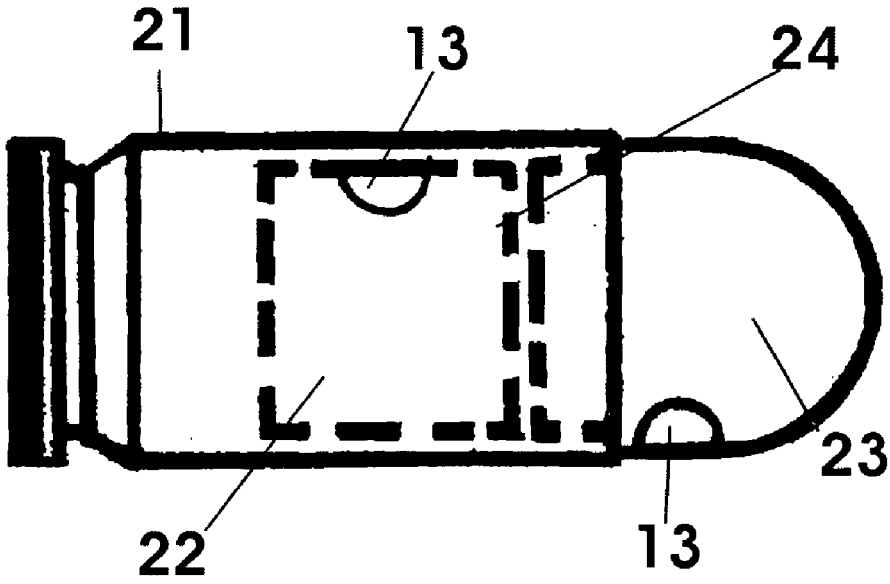
FIG. 9 is an OBP projectile with multiple portions.

Another embodiment is illustrated in FIG. 9 and would likely be used in a rifle or handgun. Each portion would have a central axis in line with the central axis of the projectile body. However, each portion has a center of gravity that is not aligned with its own central axis. Each portion of the projectile can have the center of gravity in a different orientation with respect to each other. Therefore, upon firing from a rifled barrel, the multiple portions would each deviate to reach different target strikes around a bulls-eye.

Figure 10:
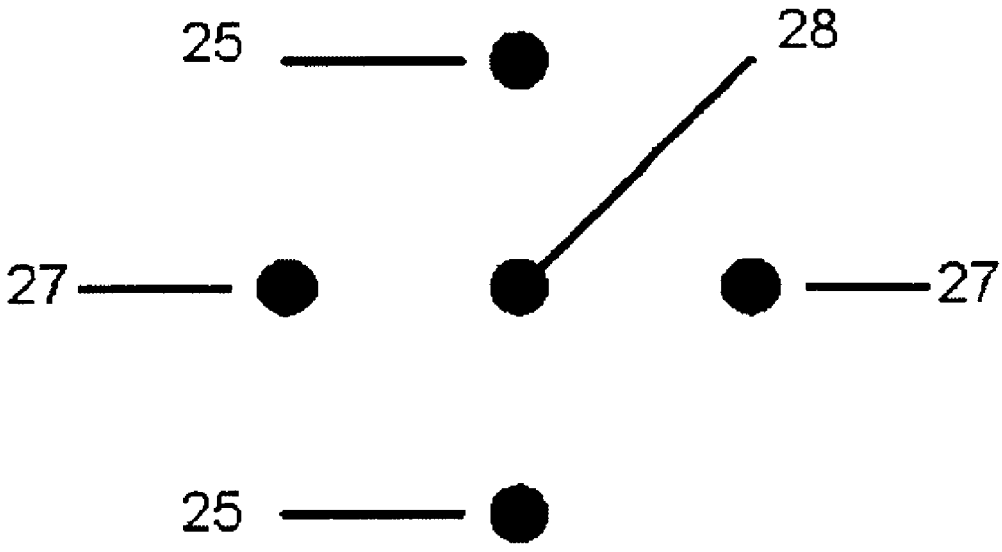
FIG. 10 is a dispersal pattern from an OBP multiple portion projectile.

In this embodiment a projectile is held in a cartridge 21 divided into multiple portions 22 and 23 by division 24. Any number of portions can be used. Upon exit from the gun barrel, strike a target in various formations. Two such possible formations are displayed in FIG. 10, where the portions can hit the target around the bullseye 28. Possible formations are strikes 25 above and below the bullseye. Another formation is a horizontal pattern with strikes at 27 on either side of the bullseye.

Figure 11:
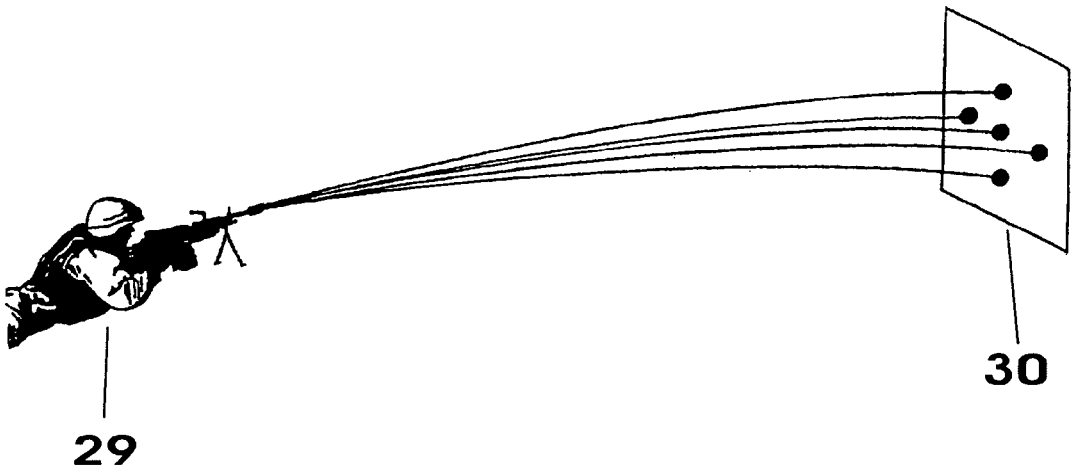
FIG. 11 is a view of a person using a machine gun to fire a five-shot salvo on a distant target in a pattern.

FIG. 11 displays a person 29 with a machine gun having fired a five-shot salvo upon a distant target 30 in a pattern. The pattern fired is representative of the pattern shown in FIG. 5.

Figure 12:
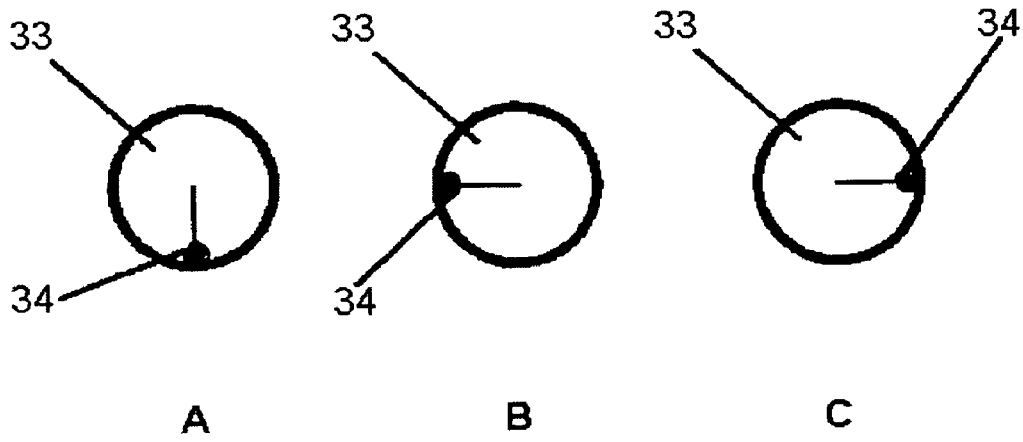
FIG. 12 is a view of center of gravity orientation indicators.

The center of gravity orientations of the projectiles can be easily determined and loaded by indicators on the aft end of OBP projectiles. FIG. 12 displays the aft end 33 of a projectile, the indicator 34, which can show the orientation of the center of gravity of the projectile. Three different orientations, a, b, and c are shown, however, there are any infinite number of positions around a 360 degree circle that can be utilized.

Autodispersion is easy to produce, enables easily varied dispersal patterns, and is an accurate method for the dispersion of projectiles.

What is claimed is:

1. A system for projectile dispersion to improve the hit probability on a target comprising:

a plurality of projectiles each having a main body, having a front end, a back end and a side;

wherein each said projectile has a central axis located longitudinally from said back end to said front end of said projectile in the center of said projectile;

wherein at least two projectiles of said plurality of projectiles have centers of mass which are offset some distance from said central axis of said projectiles;

a gun having a means to impart spin upon said plurality of projectiles and capable of firing at least two of said plurality of projectiles in rapid succession;

wherein there is a means to orient said offset center of mass of each said projectile radially in relation to said central longitudinal axis of each said projectile prior to firing whereby a predetermined pattern is created when at least two of said projectiles of said plurality of projectiles are fired in rapid succession by said gun on a target.

2. The system of claim 1 wherein, said offset centers of mass of each said projectile are located at substantially the same distance from said central longitudinal axis.

3. The system of claim 2 wherein, said means to orient each projectile of said projectiles with, offset centers of mass is arranged to provide orientation of said projectiles having said offset centers of mass radially at substantially different vectors.

4. The system of claim 3 wherein, said gun is arranged to fire said projectiles in a burst.

5. The system of claim 4 further comprising, at least one standard projectile with a center of mass along its said central axis interspersed among said projectiles whose offset centers of mass have said differing vectors of orientation.

6. The system of claim 5 wherein, said burst consists of sequentially fired in rapid success on one said standard projectile followed by said projectiles with said offset centers of mass with said differing vectors of orientation.

7. The system of claim 6 wherein, said means to orient each projectile of said projectiles with offset centers of mass is arranged to provide orientation of said projectiles with offset centers of mass whereby the predetermined pattern created is substantially linear and horizontal.

8. The system of claim 7 wherein, said gun is arranged to repeatedly fire said burst.

9. The system of claim 3 wherein, said means to orient each projectile of said projectiles with said offset centers of mass is arranged to provide for orientation of each successive said projectiles having said offset centers of mass radially at a vector which is 180 degrees from the vector of orientation of the previous said projectile having said offset center of mass.

10. The system of claim 9 wherein, said gun is arranged to fire said projectiles in a burst.

11. The system of claim 10 further comprising, at least one standard projectile with a center of mass along its said central axis interspersed among said projectiles whose offset centers of mass have said 180 degree opposing vectors of orientation.

12. The system of claim 11 wherein, said burst consists of sequentially fired, in rapid succession, said standard projectile followed by two of said projectiles with said offset centers of mass with said 180 degree opposing vectors of orientation.

13. The system of claim 12 wherein, said gun is arranged to repeatedly fire said three round burst.

14. The system of claim 3 wherein, said means to orient each projectile of said projectiles with offset centers of mass is arranged to provide orientation of successive projectiles having said offset centers of mass radially 90 degrees from the previous said projectile having, said offset center mass.

15. The system of claim 14 wherein, said gun is arranged to fire said projectiles in a burst consisting of sequentially fired, in rapid succession, at least four of said projectiles with said offset centers of mass with said 90 degree differing vectors of orientation whereby the predetermined pattern created is substantially shaped as a diamond around the aim point from said gun.

16. The system of claim 14 further comprising, at least one standard projectile with a center of mass along its said central axis interspersed among said projectiles whose offset centers of mass have said 90 degree differing vectors of orientation.

17. The system of claim 16 wherein, said burst consists of sequentially fired, in rapid succession, one standard projectile followed by four of said projectiles with said offset centers of mass with said 90 degree differing vectors of orientation whereby the predetermined pattern created is substantially shaped as a diamond around a central hit point from said standard projective.

18. The system of claim 17 wherein, said gun is arranged to repeatedly fire said five round burst.

19. The system of claim 1 wherein, said offset centers of mass of each projectile are located at substantially different distances from said central longitudinal axis.

20. The system of claim 19 wherein, said means to orient each projectile of said projectiles with said differing offset centers of mass is arranged to provide orientation of said projectiles having said differing offset centers of in mass radially at substantially different vectors.

21. The system of claim 20 wherein, said gun is arranged to fire said projectiles in a burst.

22. The system of claim 21 further comprising, at least one standard projectile with a center of mass along its said central axis interspersed among said projectiles whose differing offset centers of mass have said differing vectors of orientation.

23. The system of claim 22 wherein, said burst consists of sequentially fired, in rapid succession, one said standard projectile followed by said projectiles with said differing offset centers of mass with said differing vectors of orientation.

24. The system of claim 23 wherein, said means to orient each projectile of said projectiles with offset centers of mass is arranged to provide orientation of said projectiles with offset centers of mass whereby the predetermined pattern created is substantially linear and horizontal.

25. The system of claim 24 wherein, said gun is arranged to repeatedly fire said burst.

26. The system of claim 1 further comprising, a means of indicating said radial orientation of said projectiles with said offset centers of mass.

27. The method as recited in claim 1 wherein, the means to impart spin on said plurality of projectiles is a rifled barrel.

28. The system of claim 1 further comprising, a means to offset said centers of mass of said projectiles selected from the group consisting of extraction of mass from said side of said projectile attachment of mass to said side of said projectile, replacement of portions of said body of said projectile with a less dense material than the material comprising the projectile, replacement of portions a of said body of said projectile with a more dense material than the material comprising the projectile, replacement of certain portions of said body of said projectile with said less dense material and simultaneous replacement of other portions of said body with a more dense material, and formation of at least one void within said body of said projectile.

29. A system for projectile dispersion to improve the hit probability on a target comprising:

shifting the center of mass a distance away from a central longitudinal axis of at least two of a plurality of projectiles;

firing said projectiles in rapid succession from a gun having a means to impart spin upons said plurality of projectiles and capable of firing at least two of said plurality of projectiles in rapid succession;

orienting said offset center of mass radially in relation to said central longitudinal axis of each said projectile prior to firing said plurality of projectiles from said gun whereby a predetermined pattern is created when at least two of said projectiles of said plurality of projectiles are fired in rapid succession by said gun on a target.

30. A method as recited in claim 29 wherein, shifting the offset centers of mass of each said projectile involves locating the offset centers of mass at substantially the same distance from said central longitudinal axis.

31. A method as recited in claim 29 wherein, shifting the offset centers of mass of each said projectile involves locating the offset centers of mass at substantially different distances from said central longitudinal axis.

32. A method as recited in claim 31 wherein, orienting said projectiles with said differing offset centers of mass radially at substantially different vectors.

33. A method as recited in claim 32 wherein, firing said projectiles in a burst.

34. A method as recited in claim 33 further comprising, interspersing at least one standard projectile with a center of mass along its said central axis among said projectiles whose differing offset centers of mass have said differing vectors of orientation.

35. A method as recited in claim 34 wherein, firing said burst includes sequentially firing in rapid succession, one said standard projectile followed by said projectiles with said differing offset centers of mass with said differing vectors orientation.

36. A method as recited in claim 35 wherein, orienting said projectiles with said differing offset centers of mass with said different vectors of orientation is performed whereby a predetermined pattern is created that is substantially linear and horizontal.

37. A method as recited in claim 36 wherein, firing said burst is performed repeatedly.

38. A method as recited in claim 29 wherein, orienting said projectiles with said offset centers of mass radially at substantially different vectors.

39. The method as recited in claim 38 wherein, firing said projectiles from said gun is performed in a burst.

40. The method as recited in claim 39 further comprising, interspersing at least one standard projectile with a center of mass along its said central axis among said projectiles whose offset centers of mass have said differing vectors of orientation.

41. The method as recited in claim 40 wherein, firing said burst includes firing in rapid succession, one said standard projectile followed by said projectiles with said offset centers of mass with said differing vectors of orientation.

42. The method as recited in claim 41 wherein, the step of orienting said projectiles with said offset centers of mass with said different vectors of orientation is performed whereby a predetermined pattern is created that is substantially linear and horizontal.

43. The method as recited in claim 42 wherein, the step of firing said three round burst is performed repeatedly.

44. The method as recited in claim 38 wherein, orienting each successive projectile of said projectiles having said offset centers of mass radially at a vector which is 180 degrees from the previous projectile having said offset center of mass.

45. The method as recited in claim 44 wherein, firing said projectiles from said gun is performed in a burst.

46. The method as recited in claim 44 further comprising, interspersing at least one projectile with a center of mass along its said central axis among said projectiles with said offset centers of mass having said 180 degree opposing vectors of orientation.

47. The method as recited in claim 46 wherein, firing in said burst includes firing, in rapid succession, one said standard projectile followed by said projectiles with said offset centers of mass with said 180 degree opposing vectors of orientation.

48. The method as recited in claim 47 wherein, the step of firing said three round burst is performed repeatedly.

49. The method as recited in claim 38 wherein, orienting each successive projectile of said projectiles having said offset centers of mass radially at a vector which is 90 degrees from the previous projectile having said offset center of mass.

50. The method as recited in claim 49 wherein, firing said projectiles from said gun is performed in a burst consisting of sequentially firing, in rapid succession, at least four of said projectiles with said offset centers of mass with said 90 degree differing vectors of orientation whereby the predetermined pattern created is substantially shaped as a diamond around the aim point from said gun.

51. The method as recited in claim 49 wherein, interspersing at least one standard projectile with a center of mass along its said central axis among said projectiles with said offset centers of mass having said 90 degree differing vectors of orientation.

52. The method as recited in claim 51 wherein, firing said projectiles from said gun is performed in a burst consisting of sequentially firing, in rapid succession, one said standard projectile followed by four of said projectiles with said offset centers of mass having said 90 degree differing vectors of orientation whereby the predetermined pattern obtained by firing said burst from said gun is substantially shaped as a diamond around a central hit point.

53. The method as recited in claim 52 wherein, the step of firing said five projectile burst from said gun is performed repeatedly.

54. The method as recited in claim 29 wherein, firing said projectiles from a gun is performed with a gun having a rifled barrel.

55. The method as recited in claim 29 further comprising, indicating said vector of radial orientation of said projectiles with said offset centers of mass.

56. The method as recited in claim 29 wherein shifting the center of mass off the central longitudinal axis of each projectile is performed by a step selected from the group consisting of extracting a portion of mass from said side of said projectile adding mass to said side of said projectile, replacing portions of said body of said projectile with a less dense material than the material comprising the projectile, replacing portions of the body of said projectile with a more dense material than the material comprising the projectile, replacing certain portions of said body of said projectile with a less dense material than the material comprising the projectile while simultaneously replacing other portions of the body of said projectile with a more dense material than the material comprising the projectile, and forming at least 1 void within the body of said projectile between said side and said central longitudinal axis.

* * * * *